US006374656B1

(12) United States Patent
Donini et al.

(10) Patent No.: US 6,374,656 B1
(45) Date of Patent: Apr. 23, 2002

(54) ROLLING STAND FOR PLANE PRODUCTS AND METHOD TO CONTROL THE PLANARITY OF SAID PRODUCTS

(75) Inventors: Estore Donini, Vimercate; Paolo Bobig, San Canzian di Isonzo; Cesare Galletti, Segrate S. Felice, all of (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 09/620,369

(22) Filed: Jul. 20, 2000

(30) Foreign Application Priority Data

Jul. 20, 1999 (IT) ..... UD99A0134

(51) Int. Cl.[7] ..... B21B 29/00

(52) U.S. Cl. ..... 72/241.8; 72/9.1; 72/11.7; 72/247; 72/366.2

(58) Field of Search ..... 72/9.1, 11.7, 241.2, 72/241.4, 241.8, 247, 366.2

(56) References Cited

U.S. PATENT DOCUMENTS

| | | | | |
|---|---|---|---|---|
| 4,726,213 A | | 2/1988 | Tetsuo | |
| 5,174,144 A | * | 12/1992 | Kajiwara et al. | 72/247 |
| 5,231,858 A | | 8/1993 | Yamashita | |
| 5,592,846 A | | 1/1997 | Watanabe | |
| 5,839,313 A | * | 11/1998 | Ginzburg | 72/241.4 |
| 5,875,663 A | | 3/1999 | Tateno et al. | |
| 5,924,319 A | * | 7/1999 | Ginzburg | 72/247 |
| 5,950,478 A | * | 9/1999 | Sato et al. | 72/247 |
| 6,158,260 A | | 12/2000 | Ginzburg | |

FOREIGN PATENT DOCUMENTS

JP 63-002507 * 7/1988 ..... 72/241.8

OTHER PUBLICATIONS

"Modernisierung der Kaltwalzanlage Bei Der Krupp–VDM GmbH" vol. 116, No. 5, May 10, 1996 pp. 101–114, 152, Stahl und Eisen, de, Verlag Stahleisen GmbH, p. 102, right column.

Patent Abstracts of Japan, vol. 012, No. 091 (M–679) Mar. 24, 1988 & JP 62 230412 Sumitomo Metal Ind. Ltd., Oct. 9, 1987.

Development of Accurate Control Techniques of Strip Shape and Edge–Drop in Cold Rolling, Yamamoto, Journal of the Iron and Steel Institute of Japan, vol. 79, No. 3, Jan. 1, 1993 pp. 388–394.

Patent Abstracts of Japan, vol. 015 No. 294 (M–1140) Jul. 25, 1991 & JP 03 106507 Sumitomo Metal Ind. Ltd, May 7, 1991.

* cited by examiner

*Primary Examiner*—Ed Tolan

(57) ABSTRACT

Rolling stand (10) for plane products and method to control the planarity of said plane products, said rolling stand comprising a pair of working rolls (11*a,* 11*b*), a corresponding pair of back-up rolls (13*a,* 13*b*) and at least an intermediate roll (15*a*) located between one of said working rolls (11*a*) and a corresponding back-up roll (13*b*), axial translation means (16) and bending means (17) being associated with at least one of said working rolls (11*a*) to translate it axially and respectively bend it, crossing means (19) being associated with said intermediate roll (15*a*) to arrange it with its longitudinal axis (25*a*) inclined, that is, rotated, with respect to the longitudinal axes (21*a,* 21*b,* 23*a,* 23*b*) of said working rolls (11*a,* 11*b*) and of said back-up rolls (13*a,* 13*b*).

15 Claims, 6 Drawing Sheets

ROLLING STAND FOR PLANE PRODUCTS AND METHOD TO CONTROL THE PLANARITY OF SAID PRODUCTS

FIELD OF THE INVENTION

This invention refers to a rolling stand for plane products, such as strip or similar, and an associated method to control the planarity of said strip. The stand is advantageously of the six-high type, with a pair of working rolls (WR) bevelled at least at one end and associated with both negative and positive bending mechanisms and axial displacement, or shifting, mechanisms, a pair of back-up rolls (BUR), and a pair of intermediate rolls (IR) associated with crossing mechanisms.

The planarity control method provides that the quadratic components, the fourth order components and the edge-drop of the profile of the rolled strip are controlled in a coordinated manner. To be more exact, the quadratic and fourth order components can also be controlled with a high dynamic performance.

BACKGROUND OF THE INVENTION

The state of the art includes six-high rolling stands for plane products, comprising a pair of working rolls, a pair of back-up rolls and a pair of intermediate rolls, wherein, to control the planarity of the rolled product both the working rolls and the intermediate rolls are associated with both negative and positive bending systems, and wherein the intermediate rolls are also associated with a system of long axial translation (macro shifting).

These rolling stands, however, have the disadvantage that they cannot completely and efficiently compensate edge-drop, and require a particularly long axial translation of the intermediate rolls.

Another disadvantage of such rolling stands, which provide for the shifting of the intermediate rolls, is that the speed at which the shifting is performed is extremely slow compared with the rolling speed, that is to say, about 1/1000 of the latter. Therefore, if the setting of the stand is not correct, since the inlet profile of the product being rolled is different from the aspected profile, or the rolling force is different from the initial expected one, there is a delay in the re-setting of the stand, for example because of the speed of shifting, with a resulting loss of planarity for a length of strip which is equal to the time taken to reset the stand multiplied by the rolling speed. To at least partly solve this problem of compensating the edges, there have already been proposals for rolling stands with a system of axial translation of the working rolls in the same direction as the intermediate rolls and wherein the working rolls are equipped with appropriate bevels or hollows at the ends.

Moreover, the state of the art also includes a rolling stand wherein the intermediate rolls (IR) are associated with crossing means suitable to reduce the so-called "strip walking".

The present Applicant has devised, designed and perfected a rolling stand for plane products and a method to control the planarity of said products according to the invention to overcome the shortcomings described above and to perfect the rolling stands known in the state of the art.

SUMMARY OF THE INVENTION

The rolling stand for plane products and the method to control the planarity of said products according to the invention is set forth and characterised in the main claims, while the dependent claims describe other innovative features of the invention.

One purpose of the invention is to achieve a rolling stand for plane products, such as strip or similar, which will make possible to control and adjust, autonomously and independently, also during rolling, the $x^2$ component, the $x^4$ component and also components of a higher order, which consequently makes it possible to control the edge-drop of the rolled product, that is to say, components up to $x^{10}$.

In accordance with this purpose, the rolling stand for plane products according to the invention comprises a pair of working rolls, a corresponding pair of back-up rolls and at least an intermediate roll located between one of the working rolls and a corresponding back-up roll, shifting means and bending means associated with at least one of the working rolls to translate it axially and respectively bend it, and crossing means associated with the intermediate roll to arrange it with its longitudinal axis inclined, that is, rotated, with respect to the longitudinal axes of the working rolls and the back-up rolls.

Before describing the invention in detail, it is appropriate to make the following premises.

The ability to control the profile of the strip being rolled is generally shown in the plane $x^2$, $x^4$ (FIG. 5), where $x^2$ and $x^4$ are the second and fourth order components of the function $y(x)=a_0+a_1x+a_2x^2+a_3x^3+\ldots+a_{10}x^{10}$, which represents the thickness of the strip (FIG. 6).

If the thickness is symmetrical, as it should be, the odd components should not be present. At most, we might find the component $a_1x$ which indicates the presence of strip with a wedge defect, that is, a profile which is on average trapezoid with edges of a different thickness, as shown in FIG. 7.

The more efficient a stand is at controlling the shape, the wider is the zone $x^2$, $x^4$ which can be controlled; FIG. 8 shows two areas, the most extensive of which refers to a system with a higher control capacity than the more inward area.

If a stand has high dynamic performance in controlling the shape of the strip, this means that it is possible to pass quickly from a point A (FIG. 9) to a point B in the plane $x^2$, $x^4$. Then, together with an area of "static" or preset control, an area of "dynamic" control is also shown, clearly included in the area of static control which moves inside the area of global control (FIG. 10) according to the initial static functioning point "0".

Since every actuator suitable to control the movements of the working rolls and intermediate rolls, in every operating condition (that is, roll diameters, strip width, inlet profile, rolling force, etc.) has its own "line of action", to pass with complete freedom from a point A to a point B, it is generally necessary to have two actuators AT1 and AT2 which move in their own directions d1 and respectively d2 (FIG. 11). Therefore, in the field of dynamic control, to have the possibility to pass from A to B without constraints on position B, the two necessary actuators must also have lines of action which are not parallel.

This having been said, FIG. 12 shows the control of the crossing of an intermediate roll (IR) according to the invention, wherein it can be noticed how the influence of $x^2$ has limited collateral effects on $x^4$, since the ratio between $x^2$ and $x^4$ is about 1/10. Therefore, by acting on IR crossing we have very limited effects on the $x^4$ component.

From the detail shown in FIG. 13, in which the two working rolls (WR) are shown, it can be seen how WR shifting prevalently influences the edges of the strip, if the working roll is appropriately bevelled.

WR shifting influences both $x^2$ and $x^4$ but in a very limited way compared with WR bending and IR crossing. WR shifting is practically defined by the width of the strip, with very small adjustments according to the actual edge-drop on the strip at outlet. The ratio between $x^2$ and $x^4$ is about 1.

As can be seen in FIG. 14, WR bending influences both $x^2$ and $x^4$. The ratio $x^4/x^2$ depends on the choice of the diameters of the rolls of the stand and on the width of the strip (rolling force, etc.), and is in any case near 1.

The influence of IR crossing and WR bending on the edges of the strip is very limited, and therefore when IR crossing and WR bending is varied, it is not necessary to modify the set of WR shifting.

Therefore, the rolling stand according to the invention is equipped with means which allow IR crossing, WR shifting and WR bending.

To be more exact, WR shifting is used to pre-set the working rolls according to the edge-drop.

The stand according to the invention provides to actuate a shifting action on the working rolls in order to allow an adequate control of the shape of the strip edges for all the strip width values provided for a given rolling stand.

The working rolls are therefore associated with translation means able to displace them axially one with respect to the other, with a travel which may even reach several tens of centimetres, so as to be able to process plane rolled products with very variable widths.

The value of the shifting travel "S" to be achieved can be defined by the following formula: $S=(L_{max}-L_{min})/2+EC$, where $L_{max}-L_{min}$ are respectively the values of maximum and minimum width of the strip to be worked, and EC represents the extra travel which has to be provided to allow the action of the bevels in correspondence with the edges.

In the case of a six-high stand for cold rolling, the values of maximum and minimum width are respectively of about 1,200 mm and 600 mm, therefore the shifting value "S" is at least 300÷350 mm, taking into account a certain value of extra travel.

In the case of a six-high stand for hot rolling, the values are respectively about 2,600 mm and 1,300 mm, therefore the shifting value "S" is at least 650÷700 mm.

This constitutes a "static" actuator which does not influence the field of control $x^2$, $x^4$ since it is constrained only to the desired edge-drop correction.

IR crossing is used to pre-set the IR to obtain a desired $x^2$ component. IR crossing is obtained by means of a preset actuator which is however used in rolling too, to change the $x^2$ component and allow, together with WR bending, a total dynamic control.

IR shifting, as in conventional stands, practically has an influence only on $x^2$ (the $x^4/x^2$ ratio is equal to about 1/15), and has an $x^2$ variation action reduced by about 3–4 times compared with those of IR crossing. The comparison is between IR shifting, with a travel for example of about 300 mm and IR crossing with a rotation of up to about 1.5°. Therefore IR crossing is much more efficient.

Moreover, IR shifting, where it is included, is variable in rolling, with shifting speeds of 1/1000 of rolling speeds to prevent damage to the surfaces of the rolls. With a rolling speed of 20 m/sec we have a shifting speed of 20 mm/sec. Therefore, it would take 10 secs to carry out the whole control travel.

The IR crossing speed is higher, at about 0.1°/sec. Consequently, to have the same $x^2$ variation corresponding to the whole shifting travel (in the embodiment which includes IR shifting), it is enough to vary the crossing angle by 0.2–0.6° according to the starting point (FIG. 15). Moreover, crossing is quicker: 0.2–0.6° are varied in 2–6 secs, whereas with IR shifting it needs at least 10 secs to carry out the whole travel and obtain the same effects on the strip.

Thanks to the high control capacity of IR crossing, which as we have seen is on average about three times more than that of IR shifting in conventional stands, it is possible to use IR crossing also in a five-high stand, keeping high the capacity to control the profile of the strip.

According to a preferential embodiment of the invention, a pair of intermediate rolls is located between the pair of working rolls and the pair of back-up rolls, therefore the rolling stand is the six-high type.

According to a simplified variant, only one intermediate roll is arranged in the upper section between a corresponding working roll and a corresponding back-up roll, therefore the stand is of the five-high type.

According to one characteristic of the invention, the bending of each working roll can be both positive and negative.

According to another characteristic of the invention, the working rolls are provided, at least at one end, with bevels appropriately configured so as to control the profile of the edges of the rolled product.

According to another characteristic of the invention, the crossing mechanism allows to carry out the crossing of each intermediate roll quickly, during the rolling step, since the maximum rotation of the intermediate rolls, compared with the working rolls, is about 1.5° and since the speed of rotation is about 0.1°/sec, the correction operation, which requires to vary the angle by 0.2–0.6°, is carried out in about 2–6 secs.

According to another characteristic of the invention, the method to control the planarity of the plane rolled product provides a step of monitoring, by sensor means, the profile of the product emerging from the stand, and a step of acting on shifting means and bending means associated with at least one of the working rolls to translate it axially and respectively bend it, and on crossing means associated with the intermediate roll to arrange it with its longitudinal axis inclined, that is, rotated with respect to the longitudinal axes of the working rolls and the back-up rolls.

With reference to FIG. 16, in which "0" indicates the work point which represents the profile of the strip with all the actuators in the inactive position, that is to say, a "natural stand" position, and "F" indicates the point which represents the strip profile desired, it should be remembered that to obtain the desired profile it is necessary, according to the invention, to make the following two operations:

Set WR shifting to suitably correct the edge profile ("edge-drop compensation"); from point "0" we pass to an intermediate point "1";

Act on WR bending and IR crossing so as to pass from point "1" to point "F", according to the diagram shown in FIG. 16.

BRIEF DESCRIPTION OF DRAWINGS

These and other characteristics of the invention will be clear from the following description of a preferred form of embodiment, given as a non-restrictive example, with reference to the attached drawings wherein.

DETAILED DESCRIPTION OF PREFERRED EMBODIMENT

Figure 1:
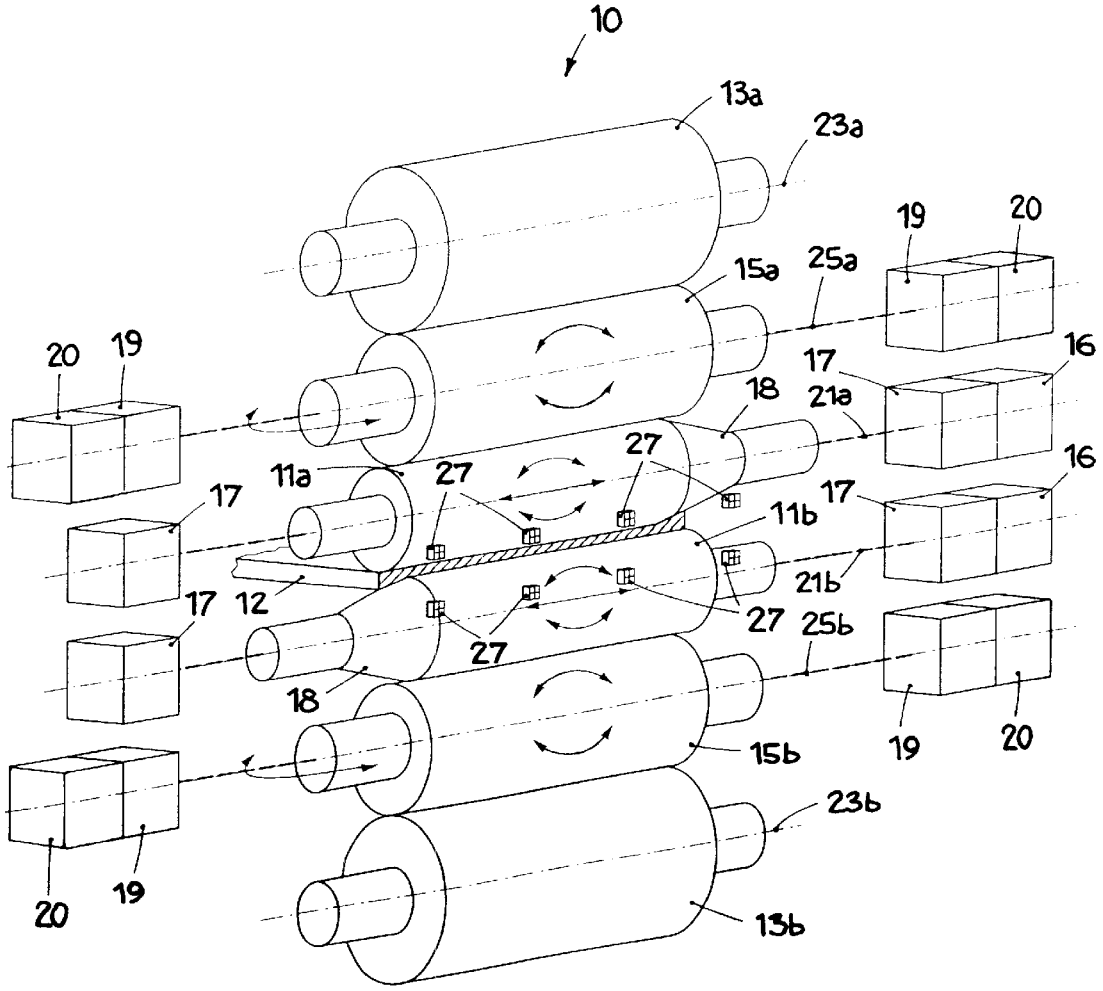
FIG. 1 is a schematic view of a six-high rolling stand according to the invention.

With reference to FIGS. 1–4, a rolling stand 10 according to the invention comprises a pair of working rolls 11*a,* 11*b* between which the plane product 12 to be rolled, consisting for example of strip, is able to pass.

Associated with the two working rolls 11*a,* 11*b,* two corresponding back-up rolls 13*a,* 13*b* are provided, able to contrast the thrust due to the rolling of the product 12.

The rolling stand 10, according to a first form of embodiment, is of the so-called six-high type, and comprises a pair of intermediate rolls 15*a,* 15*b,* located between the working rolls 11*a,* 11*b* and the back-up rolls 13*a,* 13*b*.

Associated with at least one working roll 11*a* or 11*b,* but advantageously with both, an axial translation mechanism 16, or shifting mechanism, is provided, of a conventional type and not shown in detail in the drawings. The mechanism 16 is able to displace the corresponding working roll 11*a,* 11*b* along the horizontal plane on which its longitudinal axis 21*a,* 21*b* lies, thus achieving an axial translation of one working roll 11*a* with respect to the other 11*b*.

The axial translation mechanisms 16 are able to perform a "long" shifting operation, displacing the working rolls 11*a* and 11*b* axially one with respect to the other, with a travel which may even be several hundreds of millimetres long, advantageously at least 300 mm, advantageously 350 mm, in the case of cold rolling and in the case of hot rolling, at least 650 mm, advantageously 700 mm.

This allows to work without distinction plane products 12 of any width provided for a particular stand.

Moreover, associated with at least one working roll 11*a* or 11*b,* but advantageously with both, there is also provided a bending mechanism 17, of a conventional type and not shown in detail in the drawings. The mechanism 17 is able to bend the corresponding working roll 11*a,* 11*b* in both directions with respect to the horizontal plane on which their longitudinal axis 21*a,* 21*b* lies in the inactive condition, and thus obtain a controlled bending both positive and negative.

The working rolls 11*a,* 11*b* are also provided, at least at one end, with bevels 18 suitably configured to control the profile of the edges of the rolled product 12.

The intermediate rolls 15*a,* 15*b* are associated with a crossing mechanism 19, of a conventional type and not shown in detail in the drawings. The mechanism 19 is able to incline the intermediate rolls 15*a,* 15*b* around a vertical axis 26 (FIG. 3) by a desired angle $\alpha$ in both directions with respect to the working rolls 11*a,* 11*b* and back-up rolls 13*a,* 13*b,* maintaining their longitudinal axes 23*a,* 23*b* on the same horizontal plane PIR parallel to the rolling plane on which the rolled product 12 lies Sensor means 27, of a conventional type and not shown in detail in the drawings, are provided near the working rolls 11*a,* 11*b* to monitor the profile of the rolled product 12. A ending mechanism 20 is also associated with the intermediate rolls 15*a,* 15*b,* while no shifting mechanism is associated.

The bending mechanism 20 is able to bend the corresponding intermediate roll 15*a,* 15*b,* in both directions with respect to the horizontal plane PIR on which its longitudinal axis 25*a,* 25*b* lies in its inactive condition; the mechanism 20 is thus able to obtain a controlled bending, both positive and negative.

No device to control and/or modify their position or their profiles is associated with the back-up rolls 13*a,* 13*b,* and therefore their longitudinal axes 23*a,* 23*b* are subject to remain in their nominal position.

The double effect bending (positive and negative) achieved by the bending mechanism 17 on the working rolls 11*a,* 11*b* is sufficient to allow the fourth order components ($x^4$) to be controlled. The long shifting of the working rolls 11*a,* 11*b* achieved by the mechanism 16, associated with the presence of the bevels 18 in correspondence with the ends of said working rolls 11*a,* 11*b,* allows to control the edge-drop of the rolled product 12.

The crossing mechanism 19, moreover, allows to carry out the crossing of the intermediate rolls 15*a,* 15*b* during the rolling process in a rapid fashion, considering that the maximum rotation of the intermediate rolls 15*a,* 15*b* compared with the working rolls 11*a,* 11*b* is about 1.50 and that the speed of rotation is in the order of 0.1°/sec. The method to control the planarity of the rolled products 12 provides to monitor, by means of sensors 27, the profile of the product 12 emerging from the stand 10, and to act on the mechanisms 16, 17 and 19 and possibly 20 to modify the axial setting and/or the profile (curvature) of the working rolls 11*a,* 11*b,* and also the crossing of the intermediate rolls 15*a,* 15*b,* and possibly their bending, with respect to the working rolls 11*a,* 11*b*.

With the stand 10 as described heretofore, it is possible to achieve a better control of the rolling process, compared with the state of the art, thanks to the fact that it is possible to use and control several independent functions; in fact, by crossing the intermediate rolls 15*a,* 15*b* it is mainly the quadratic components that are controlled, by bending the working rolls 11*a,* 11*b* the fourth order components are controlled, with an effect on the second order components too, and by shifting the working rolls 11*a,* 11*b* the edge-drop of the product 12 is controlled.

Figure 2:
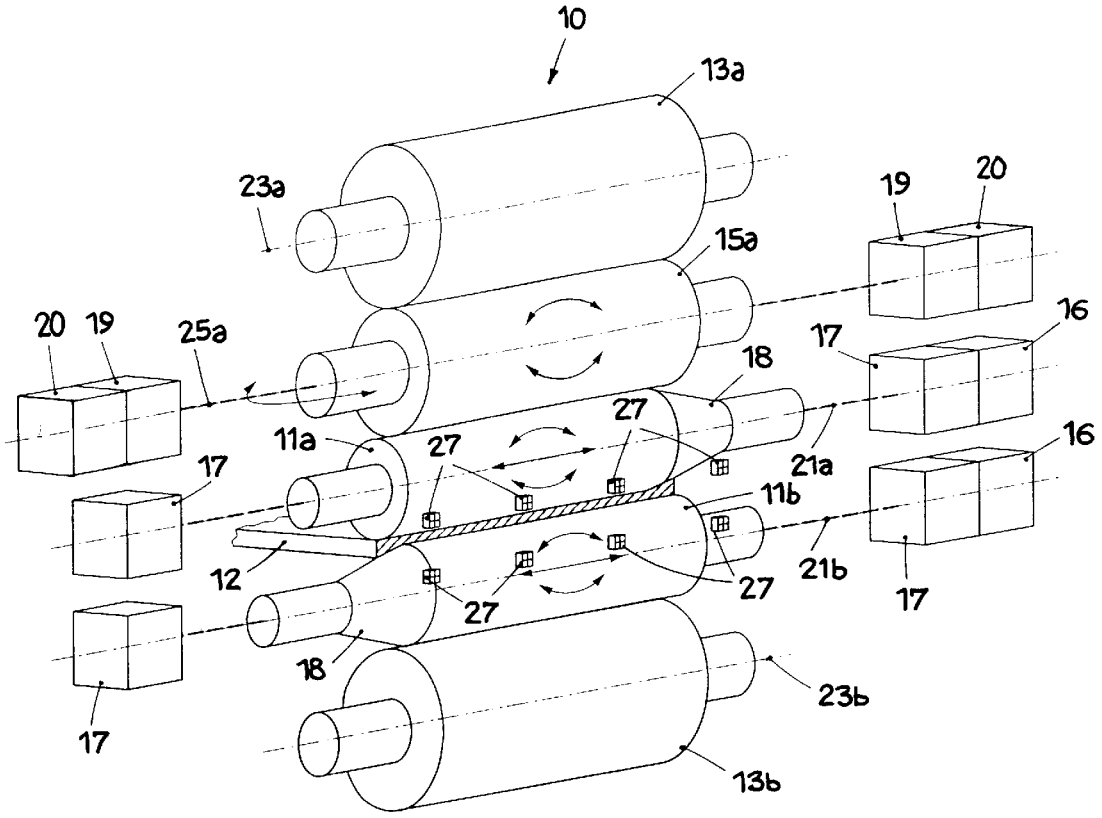
FIG. 2 is a schematic view of a five-high rolling stand according to the invention.
Figure 3:
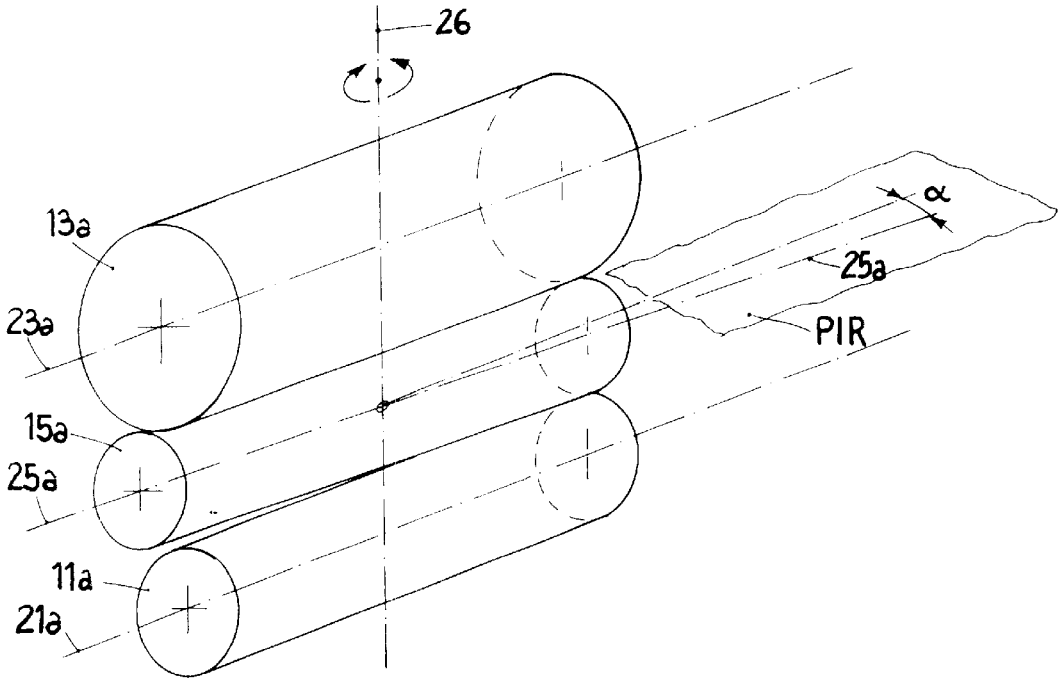
FIG. 3 is a schematic, prospective view of the pack of the upper cylinders of the rolling stand as in FIG. 1.
Figure 4:
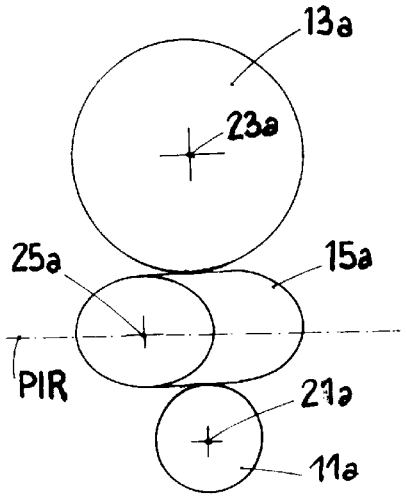
FIG. 4 is a schematic, side view of the pack of the upper cylinders of the rolling stand as in FIG. 1, without any load applied thereto.
Figure 5:
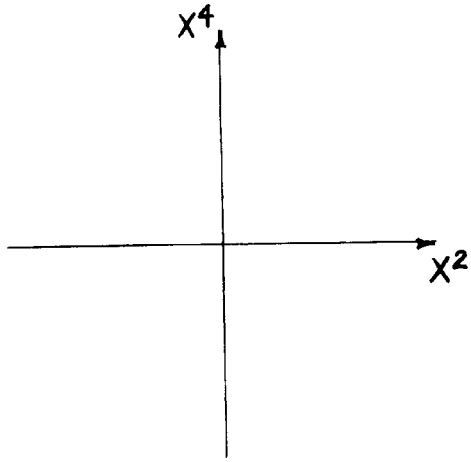
FIGS. 5–16 are graphic representations of the behaviour of the rolled strip and the components of the second and fourth order, in a rolling stand.
Figure 6:
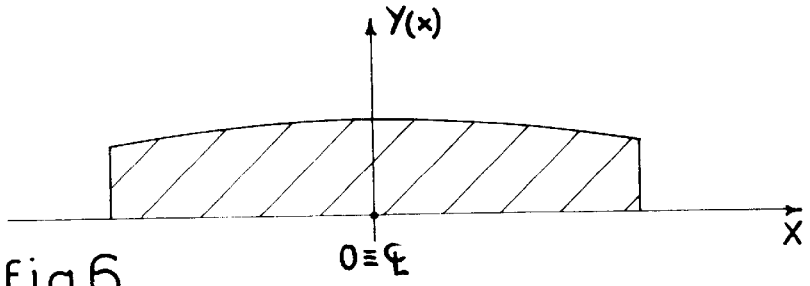
Figure 7:
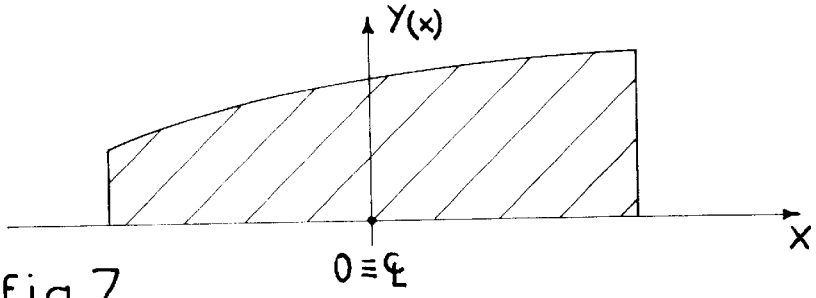
Figure 8:
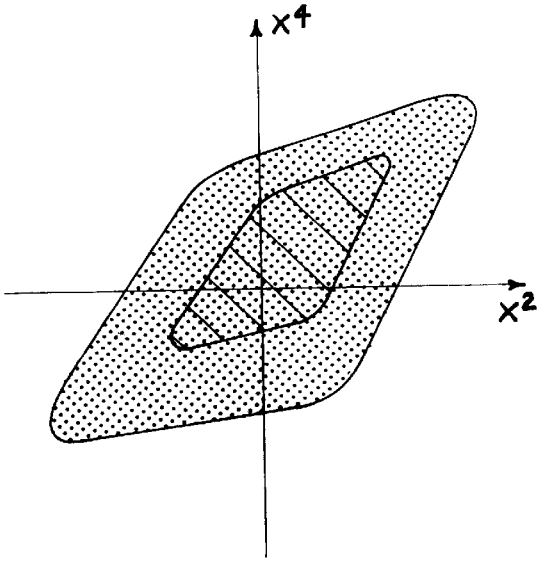
Figure 9:
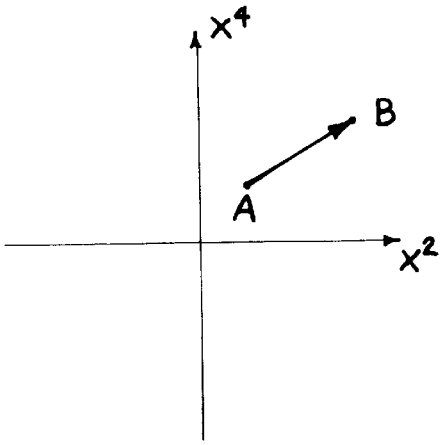
Figure 10:
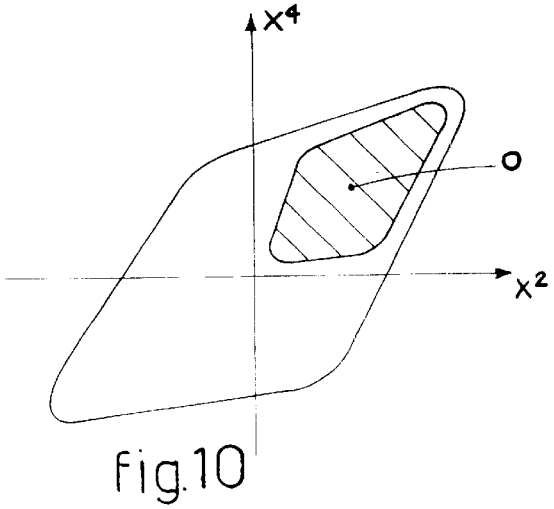
Figure 11:
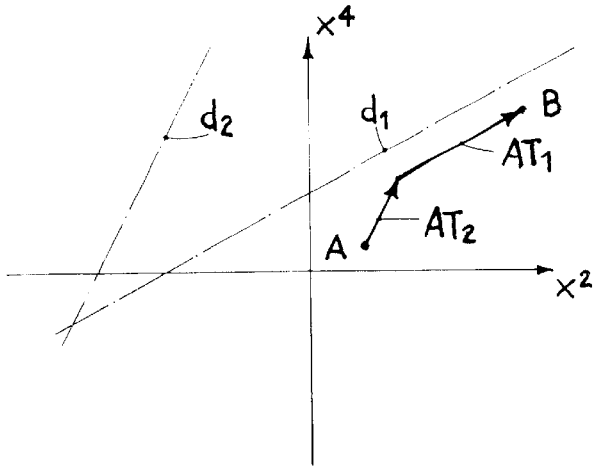
Figure 12:
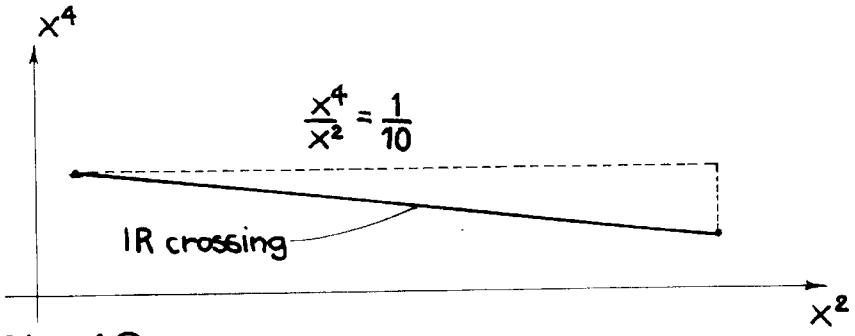
Figure 13:
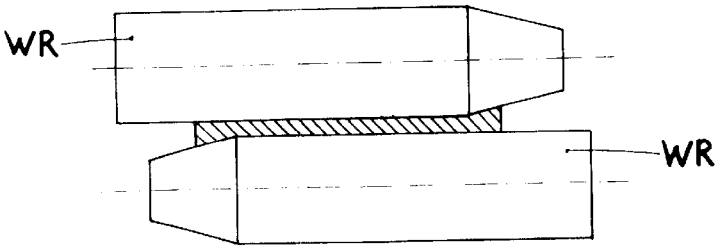
Figure 14:
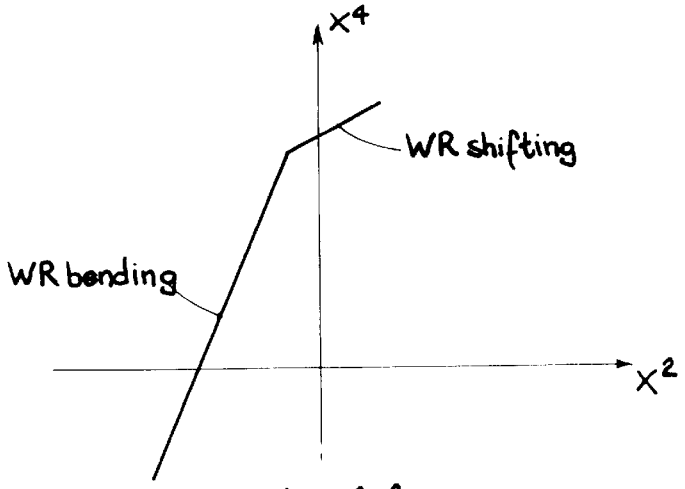
Figure 15:
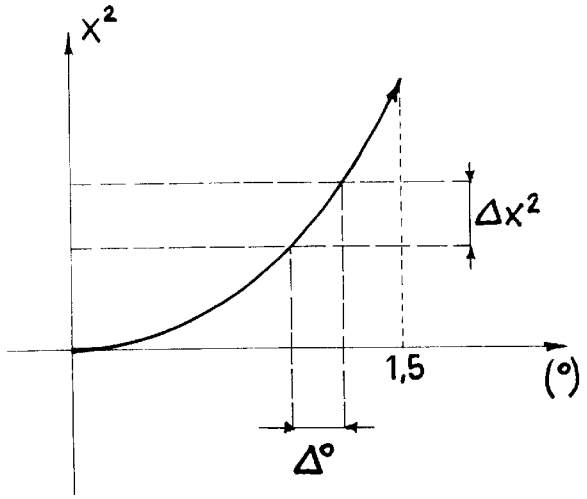
Figure 16:
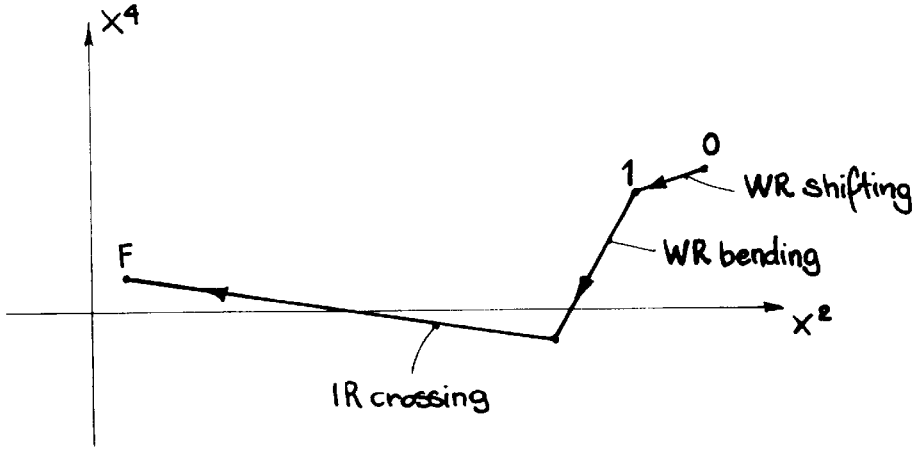

According to a simplified version as shown in FIG. 2, a rolling stand 10 according to the invention is of the so-called five-high type, and comprises only one intermediate roll 15*a* in the upper section. This five-high version allows to simplify the plant, due to the elimination of one intermediate roll and the relative crossing system, and a consequent simplification of the steps of changing the intermediate rolls, at the same time ensuring a field of control which is in any case higher than in six-high stands of a conventional type.

It is obvious that modifications and additions may be made to the rolling stand 10 and method as described heretofore, but these shall remain within the field and scope thereof.

It is also obvious that, although the invention has been described with reference to specific examples, a skilled person in the art shall certainly be able to achieve many other equivalent variants of rolling stand, but nevertheless these shall remain within the field and scope of this invention.

What is claimed is:

1. Rolling stand for plane products, comprising a pair of working rolls (11*a,* 11*b*), a corresponding pair of back-up rolls (13*a,* 13*b*) and at least an intermediate roll (15*a*) located between one of said working rolls (11*a*) and a corresponding back-up roll (13*b*), the rolling stand being characterised in that axial translation means (16) and bending means (17) are associated with at least one of said working rolls (11*a*) to translate it axially and respectively bend it, that crossing means (19) are associated with said intermediate roll (15*a*) to arrange it with its longitudinal axis (25*a*) inclined, that is, rotated with respect to the longitudinal axes (21*a,* 21*b,* 23*a,* 23*b*) of said working rolls (11*a,* 11*b*) and of said back-up rolls (13*a,* 13*b*), and in that said working rolls (11*a,* 11*b*) are provided, at least at one end, with bevels (18) appropriately configured to control the profile of the edges of said plane product.

2. Rolling stand as in claim 1, characterised in that said axial translation means (16) are able to axially displace the relative working roll (11*a,* 11*b*) associated therewith by a travel ("S") the value of which is determined by the following formula: $S=(L_{max}-L_{min})/2+EC$, where $L_{max}-L_{min}$ are respectively the values of maximum and minimum width of a plane product which can be worked, and EC represents an extra travel provided to allow an action to control the profile of the edges of said plane product.

3. Rolling stand as in claim 2, characterised in that in the case of cold rolling, the minimum shifting value of the working rolls (11*a,* 11*b*) is equal to about 300 mm.

4. Rolling stand as in claim 2, characterised in that in the case of hot rolling, the minimum shifting value of the working rolls (11*a,* 11*b*) is equal to 650 mm.

5. Rolling stand as in claim 1, characterised in that a pair of intermediate rolls are located between said pair of working rolls (11*a,* 11*b*) and said pair of back-up rolls (13*a,* 13*b*), so that said stand is of the six-high type.

6. Rolling stand as in claim 1, characterised in that a single intermediate roll (15*a*) is arranged in an upper section between a corresponding working roll (11*a*) and a corresponding back-up roll (13*a*), so that the rolling stand is of the five-high type.

7. Rolling stand as in claim 1, characterised in that said bending means (17) are able to make also double effect bends, that is, both negative and positive, on said at least one working roll (11*a*).

8. Rolling stand as in claim 1, characterised in that said crossing mechanism (19) permits the crossing of each intermediate roll (15*a,* 15*b*) quickly, during the rolling step, the maximum rotating of the intermediate rolls (15*a,* 15*b*) being about 1.5° with respect to the working rolls (11*a,* 11*b*), and the speed of rotation being about 0.1° per sec.

9. Rolling stand as in claim 1, characterised in that a pair of intermediate rolls is provided, each of said intermediate rolls (15*a,* 15*b*) being associated with a bending mechanism (10), which is able to bend the corresponding intermediate roll in both directions with respect to the horizontal plane on which its longitudinal axis (25*a,* 25*b*) lies in an inactive condition, and thus obtain a controlled bending, both positive and negative.

10. Method to control planarity of a plane product (12) rolled in a rolling stand (10) comprising a pair of working rolls (11*a,* 11*b*), each of the working rolls being provided, at least at one end, with bevels (18) appropriately configured to control the profile of the edges of said plane product, a corresponding pair of back-up rolls (13*a,* 13*b*) and at least an intermediate roll (15*a*) located between one of said working rolls (11*a*) and a corresponding back-up roll (13*b*), the method being charcterised in that it provides a step to monitor, by means of sensor means (27), the profile of the product (12) emerging from said rolling stand (10), and to act on axial translation means (16) and bending means (17) associated with at least one of said working rolls (11*a*) to translate it axially and respectively bend it, and on crossing means (10) associated with said intermediate roll (15*a*) to arrange it with its longitudinal axis (25*a*) inclined, that is, rotated, with respect to the longitudinal axes (21*a,* 21*b,* 23*a,* 23*b*) of said working rolls (11*a,* 11*b*) and of said back-up rolls (13*a,* 13*b*).

11. Method as in claim 10, characterised in that by means of the crossing of said intermediate roll (15*a*), the bending of said working rolls (11*a,* 11*b*) and the axial translation of said working rolls (11*a,* 11*b*), quadratic components, fourth order components and edge drop of said product (12) are controlled in a coordinated manner.

12. Method as in claim 10, characrterised in that it provides that said shifting of the working rolls (11*a,* 11*b*) has a travel ("S") of the value permitting control the shape of the edges of said plane product for all the widths provided for a particular stand, said value ("S") being at least 300 nm in the case of hot rolling.

13. A rolling stand for rolling plane products, comprising:

a pair of working rolls, each of the working rolls being provided, at one end, with bevels configured to control a profile of edges of the plane product;

a pair of back-up rolls;

at least one intermediate roll located between at least one of the working rolls and its corresponding back-up roll;

an axial translation mechanism associated with at least one of the working rolls to translate the at least one of the working rolls along its longitudinal axis;

a bending mechanism associated with at least one of the working rolls to bend the at least one of the working rolls;

a crossing mechanism associated with the at least one intermediate roll to arrange the at least one intermediate roll with its longitudinal axis rotated with respect to the longitudinal axes of the working rolls and the back-up rolls.

14. Rolling stand as in claim 13, wherein said bending mechanism is able to make also double effect bends, that is, both negative and positive, on said at least one working roll.

15. Rolling stand as in claim 13, wherein a pair of intermediate rolls is provided, each of said intermediate rolls being associated with a second bending mechanism, which is able to bend the corresponding intermediate roll in both directions with respect to the horizontal plane on which its longitudinal axis lies in an inactive condition, and thus obtain a controlled bending, both positive and negative.

* * * * *

UNITED STATES PATENT AND TRADEMARK OFFICE

CERTIFICATE OF CORRECTION

PATENT NO. : 6,374,656 B1
DATED : April 23, 2002
INVENTOR(S) : Donini et al.

It is certified that error appears in the above-identified patent and that said Letters Patent is hereby corrected as shown below:

Column 7,
Line 52, delete beginning with "9. Rolling stand as in claim 1, characterised in that a pair" to and including "tive and negative."
Line 59, and insert the following claim:
-- 9. Rolling stand as in Claim 1, characterised in that a pair of intermediate rolls is provided, each of said intermediate rolls (15a, 15b) being associated with a bending mechanism (20), which is able to bend the corresponding intermediate roll in both directions with respect to the horizontal plane on which its longitudinal axis (25a, 25b) lies in an inactive condition, and thus obtain a controlled bending, both positive and negative. --
Line 60, delete beginning with "10. Method to control planarity of a plane product (12)" to and including "rolls (13a, 13b)."

Column 8,
Line 17, insert the following claim:
-- 10. Method to control planarity of a plane product (12) rolled in a rolling stand (10) comprising a pair of working rolls (11a, 11b), each of the working rolls being provided, at least at one end, with bevels (18) appropriately configured to control the profile of the edges of said plane product, a corresponding pair of back-up rolls (13a, 13b) and at least an intermediate roll (15a) located between one of said working rolls (11a) and a corresponding back-up roll (13b), the method being characterised in that it provides a step to monitor, by means of sensor means (27), the profile of the product (12) emerging from said rolling stand (10), and to act on axial translation means (16) and bending means (17) associated with at least one of said working rolls (11a) to translate it axially and respectively bend it, and on crossing means (19) associated with said intermediate roll (15a) to arrange it with its longitudinal axis (25a) inclined, that is, rotated, with respect to the longitudinal axes (21a, 21b, 23a, 23b) of said working rolls (11a, 11b) and of said back-up rolls (13a, 13b).
Line 24, delete beginning with "12. Method as in claim 10, characterised in that it" to and including "the case of hot rolling."

UNITED STATES PATENT AND TRADEMARK OFFICE

CERTIFICATE OF CORRECTION

PATENT NO. : 6,374,656 B1
DATED : April 23, 2002
INVENTOR(S) : Donini et al.

It is certified that error appears in the above-identified patent and that said Letters Patent is hereby corrected as shown below:

Column 8 (continued),
Line 29, insert the following claim:
-- 12. Method as in Claim 11, characrterised in that it provides that said shifting of the working rolls (11a, 11b) has a travel ("S") of the value permitting control the shape of the edges of said plane product for all the widths provided for a particular stand, said value "(S") being at least 300 mm in the case of cold rolling and at least 650 mm in the case of hot rolling. --

Signed and Sealed this

Second Day of July, 2002

*Attest:*

*Attesting Officer*

JAMES E. ROGAN
*Director of the United States Patent and Trademark Office*